United States Patent [19]

Bene et al.

[11] 4,219,977

[45] Sep. 2, 1980

[54] LOG BUILDING CONSTRUCTION

[75] Inventors: Robert Bene, Andover; Joseph A. Fortini; Maximiliano Giacomini, both of New Haven, all of Conn.

[73] Assignee: Country Log Homes, Inc., Ashley Falls, Mass.

[21] Appl. No.: 918,564

[22] Filed: Jun. 23, 1978

[51] Int. Cl.[2] ..... E04B 1/10

[52] U.S. Cl. ..... 52/94; 52/73; 52/233

[58] Field of Search ..... 52/233, 92, 94, 95, 52/73

[56] References Cited

U.S. PATENT DOCUMENTS

| | | | |
|---|---|---|---|
| 2,005,921 | 6/1935 | Reither | 52/233 |
| 3,256,654 | 6/1966 | Pinkney, Jr. | 52/95 |
| 3,676,973 | 7/1972 | Kellert | 52/262 |
| 3,908,322 | 9/1975 | Shoaf | 52/233 |

FOREIGN PATENT DOCUMENTS

| | | | |
|---|---|---|---|
| 645222 | 7/1962 | Canada | 52/233 |
| 2608373 | 9/1976 | Fed. Rep. of Germany | 52/233 |
| 27400 | 4/1919 | Norway | 52/233 |

*Primary Examiner*—Alfred C. Perham
*Attorney, Agent, or Firm*—McCormick, Paulding & Huber

[57] ABSTRACT

A prefabricated log building has walls formed by horizontally extending, vertically stacked log courses joined by tongue and groove joints. The walls are joined at corners by mortise and tenon joints. Each tenon is partially defined by a portion of a tongue on an associated log and extends into a mortise partially defined by a portion of another tongue on another log. The tongue and groove joints cooperate with the mortise and tenon joints to form weathertight barriers which extend through the building corners. Joists supported by the upper log course of an associated wall extend in cantilever position beyond the wall and support rafters. Filler logs connected in tongue and groove relation to the upper log course extend between the joists. A soffit carried by the joists may cooperate with a tongue on the upper log course or with tongues on the filler logs to form a weathertight eave structure.

14 Claims, 9 Drawing Figures

LOG BUILDING CONSTRUCTION

BACKGROUND OF THE INVENTION

This invention relates in general to log structures and deals more particularly with improvements in prefabricated log buildings. The present invention relates particularly to buildings formed from natural logs which may vary somewhat in diameter and which are partially finished and precut to interfit for rapid accurate assembly. Log buildings of the aforedescribed general type are characterized by relatively thick walls which provide a high degree of natural insulation without further interior or exterior finishing. However, in order to realize maximum benefit from the natural insulating qualities of the wood it is essential that the joints between adjacent log courses and at the corners of the building be substantially weathertight. One common type of roof construction utilized in such log buildings includes rafters which have bird-mouthed notches to engage upper log courses of the associated building walls so that the latter log courses are substantially shielded from the rays of the sun. Such a closely overhanging roof structure may also interfere, to some degree, with air circulation near the upper portion of the walls so that the upper log courses may become affected by mildew or mold. Further, joints at the juncture between the walls and the roof of the building and the arrangement of insulation at this juncture is often unsatisfactory, resulting in excessive heat loss in this critical region. The present invention is concerned with the aforesaid problems.

SUMMARY OF THE INVENTION

In accordance with the present invention a log building has a log joint formed by horizontally extending logs assembled in right angular relation to each other. Each log has horizontally disposed upper and lower planed surfaces. A tongue projects from the upper surface of each log and extends longitudinally thereof. Each log also has a groove which opens through its lower surface and extends in parallel relation to its tongue. A vertically disposed mortise opens laterally outwardly through one log in spaced relation to one of its ends and has a generally V-shaped outwardly diverging outer end portion and a generally rectangular inner end portion which forms a junction with the outer end portion. Another log has a tenon which is received in and substantially complements the inner end portion and an associated part of the outer end portion of the mortise,

DETAILED DESCRIPTION OF PREFERRED EMBODIMENTS

Figure 1:
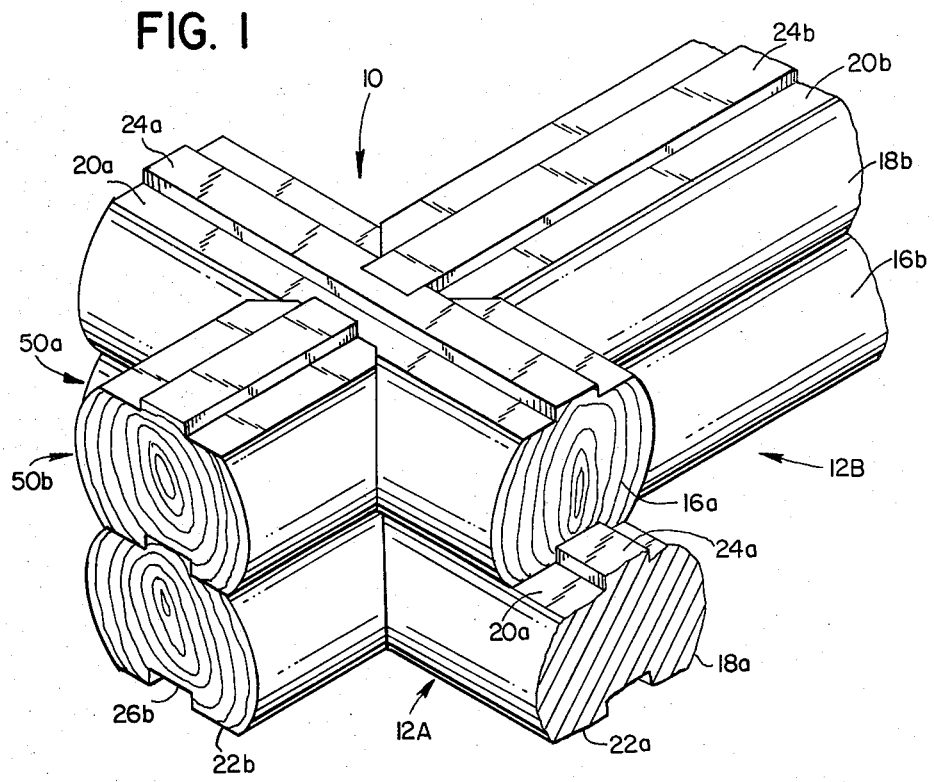
FIG. 1 is a fragmentary perspective view of a corner of a building embodying the present invention.

Turning now to the drawings and referring particularly to FIGS. 1–5, a building embodying the present invention has a corner, indicated generally at 10, formed by intersecting walls, designated generally at 12A and 12B. The walls are respectively formed by courses of logs from which bark is or may be stripped or peeled and which have finished interengaging portions, as will be hereinafter further described. The logs may vary in diameter within a predetermined range and retain a rustic appearance except for the previously mentioned finished portions, however, for convenience the logs illustrated in the drawings are of uniform appearance.

Considering the building corner 10 in further detail, the wall 12A is formed by a plurality of horizontally extending log courses arranged in vertically stacked tongue and groove relation and includes logs 16*a* and 18*a*. Similarly, the wall 12B comprises a plurality of logs laid horizontally upon each other in tongue and groove relation and includes logs 16*b* and 18*b*. Each log course of the wall 12A is joined at a right angle corner to an associated log course of the wall 12B by a mortise and tenon joint.

Figure 2:
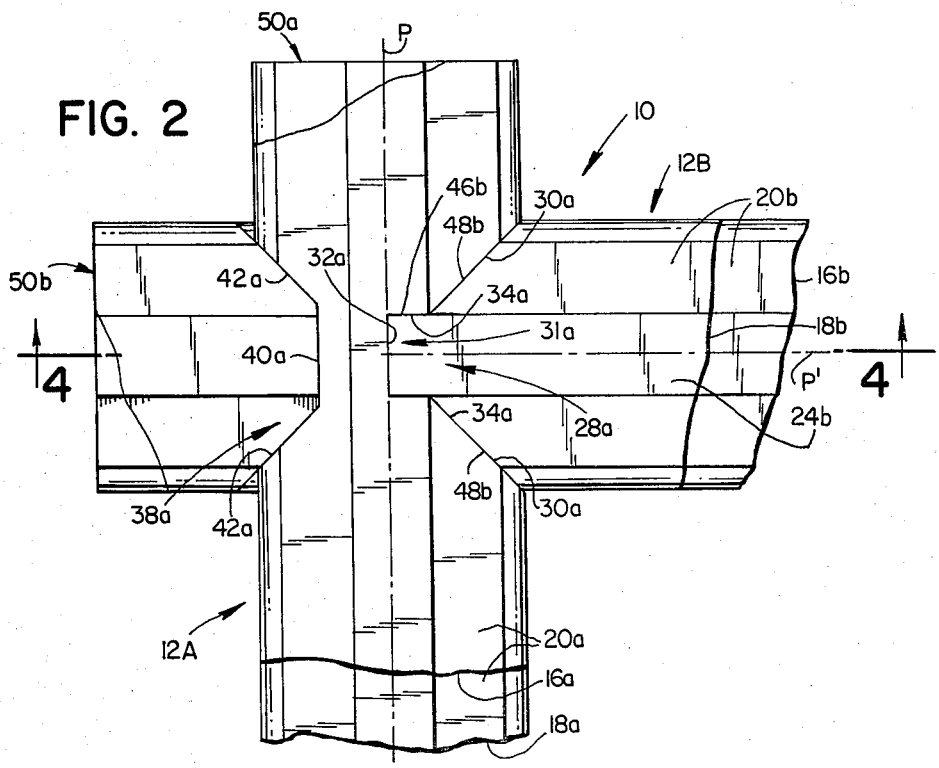
FIG. 2 is a fragmentary plan view of the building corner shown in FIG. 1.
Figure 3:
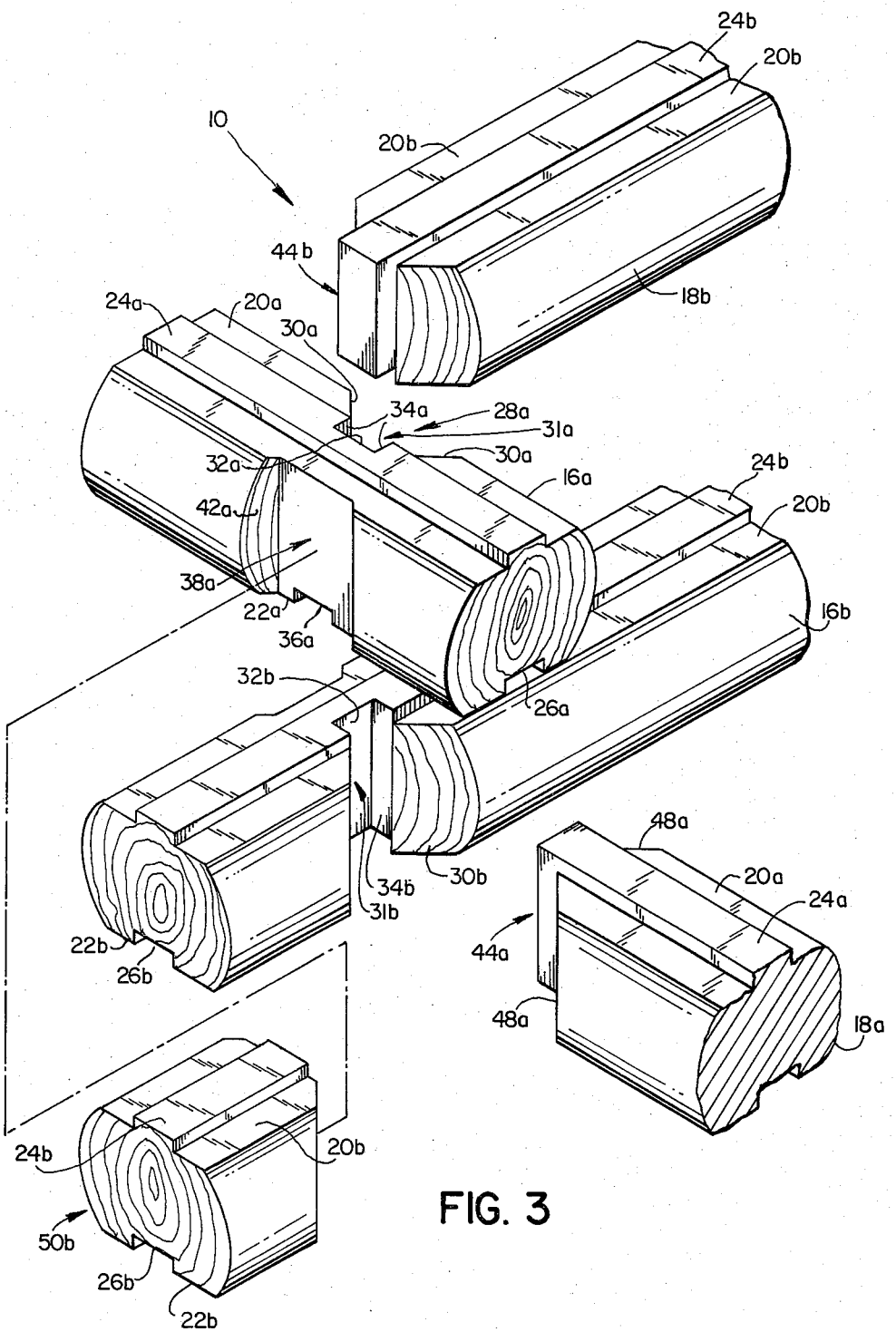
FIG. 3 is a fragmentary exploded perspective view of several component parts of the corner shown in FIG. 1.
Figure 4:
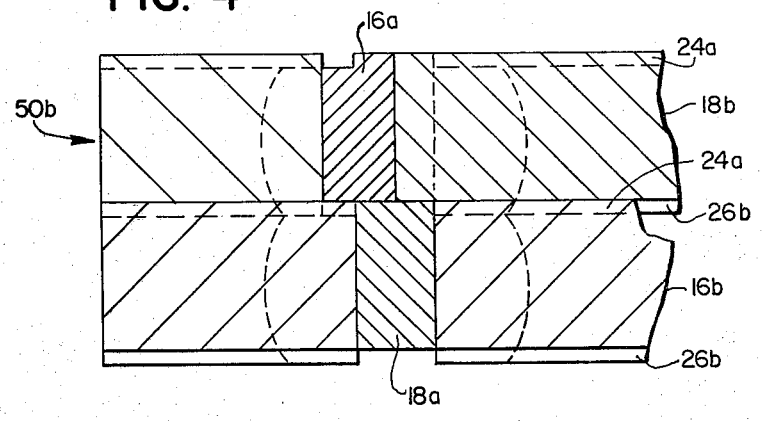
FIG. 4 is a fragmentary sectional view taken along the line 4—4 of FIG. 2.

Referring now particularly to FIG. 3, the log 16*a*, designated a mortise log, comprises a log cant which has horizontally disposed upper and lower finished surfaces respectively designated at 20*a* and 22*a*. A tongue 24*a*, which has a generally rectangular cross section, projects above the upper surface 20*a* and extends longitudinally of the log 16*a*. A groove 26*a* opens through the lower surface 22*a* and extends longitudinally of the log in parallel relation to its tongue 24*a*. The groove has a generally rectangular cross section which substantially complements the vertical cross section of the tongue 24*a*. The longitudinal center lines of the tongue 24*a* and the groove 26*a* lie generally within a vertical reference plane P, shown in FIG. 2, which contains the longitudinal center line of the log 16*a*.

A vertically disposed notch or mortise, indicated generally at 28*a*, is formed in the log 16*a* and spaced inwardly from an associated one of its ends. The mortise 28*a* opens laterally outwardly through one side of the log and has a generally V-shaped outwardly diverging outer end portion defined by vertically disposed wall surfaces 30*a*, 30*a* which form an included angle of 90°, as best shown in FIG. 2. The wall surfaces 30*a*, 30*a* each form a 45° angle with the plane P, substantially as shown. The mortise 28*a* further includes a generally rectangular inner end portion indicated generally at 31*a* and defined by a vertically disposed inner end wall 32*a*, which lies within the reference plane P, and a pair of opposing vertically disposed side walls 34*a*, 34*a* which form junctions with the side walls 30*a*, 30*a*. The width of the rectangular inner end portion 31*a*, measured longitudinally of the log 16*a*, is substantially equal to the width of its tongue 24*a*. Its lateral depth is approximately one-half the thickness of the tongue. It should also be noted that the mortise inner end portion 31*a* is partially defined by the tongue 24*a*.

Figure 5:
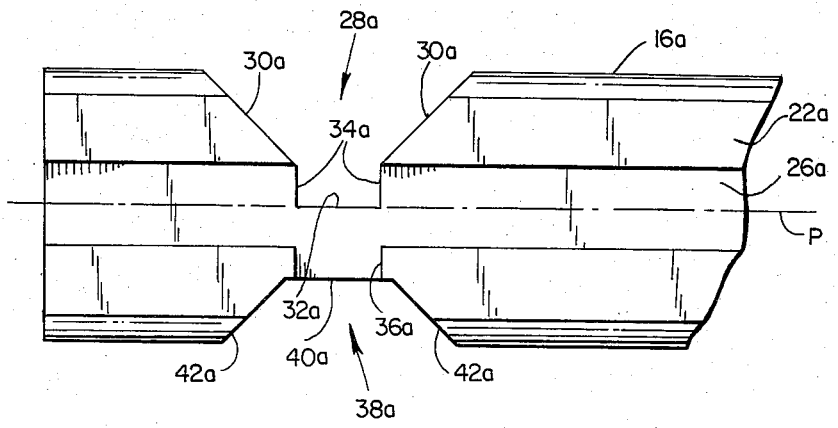
FIG. 5 is a fragmentary bottom view of a typical mortised log.

A saddle notch 36*a* formed in the log 16*a*, as best shown in FIG. 5, opens through its lower surface 22*a*, is laterally aligned with the mortise inner end portion 31*a*, and extends in a direction normal to the reference plane P. The notch 36*a* has a generally rectangular vertical cross section which complements the cross section of the tongue 24*a*.

The mortise log 16*a* may also have a shallow vertically disposed notch, such as indicated generally at 38*a*, for a purpose which will be hereinafter further discussed. The notch 38*a* is laterally aligned with the mortise 28*a*, but opens outwardly through the opposite side of the log. It is defined by a vertically disposed inner end wall 40*a* generally parallel to the plane P and a pair of vertically disposed and spaced apart side walls 42*a*, 42*a* which diverge inwardly toward the inner end wall 40*a* and toward each other. The side walls 42*a*, 42*a* form an included angle of 90° and angles of 45° with the plane P, substantially as shown. The mortise log 16*b* is substantially identical to the mortise log 16*a*, previously described, but bears the letter b suffix because of its position within the wall 12B. The log 18*b*, designated a tenon log is joined with the log 16*a* and has a tenon 44*b* formed on one end for interengagement with the mortise 28*a*. It is formed from a log cant similar to the cant used to make the log 16*a*, and has a tongue 24*b* which projects above its upper surface 20*b* and a groove 26*b* which opens through its lower surface 22*b*. The tenon 44*b* has a generally vertically disposed rectangular outer end portion 26*b*, which is partially defined by the tongue 24*b*. The width of the end portion 46*b* is substantially equal to the lateral width of the tongue 24*b*. The tenon 44*a* is further defined by vertically disposed surfaces 48*b*, 48*b* which form an included angle of 90°. The surfaces 48*b*, 48*b* further form angles of 45° with a vertical reference plane P', shown in FIG. 2, which contains the longitudinal axis of the log 18*b*. The tenon log 18*a* is substantially identical to the tenon log 18*b*, but bears the letter a suffix, because of its position within the wall 12A.

When the building corner 10 is assembled, log courses 16*a* and 16*b* and log courses 16*b* and 18*a*, respectively, are assembled in interfitting relation, substantially as shown in FIGS. 1 and 3. Specifically, the tenon 44*b* on the log 18*b* is received within the mortise 28*a* formed in the log 16*a*. In like manner, the tenon log 18*a* is assembled with the mortise log 16*b*.

In assembly, the tongue 24*a* on the log 18*a* extends for some distance into the tongue 24*b* on the log 16*b*. In like manner, a portion of the tongue on the log 18*b* extends into the tongue on the log 16*a* with which the log 18*b* is joined. The groove 26*a* in the log 16*a* receives the tongue 24*a* on the log 18*a* immediately therebelow. The straddle notch 36*a* in the log 16*a* straddles an associated portion of the tongue 24*b* on the log 16*b* immediately therebelow. Thus, the tongues 24*a* and 24*b* on the logs 18*a* and 16*b* cooperate with each other and with the logs 16*a* and 18*b* to provide a substantially continuous weathertight barrier which extends through the corner 10. Thus, when the log courses which comprise the walls 12A and 12B are assembled in vertically stacked tongue and groove relation, each mortise joint cooperates with an associated tongue and groove joint to provide a substantially continuous weathertight barrier which extends through the building corner 10.

If desired, slight clearance may be provided between each tongue and its associated groove and/or each mortise and its associated tenon to accommodate a suitable sealing or caulking compound. However, the various tongues and grooves and mortise and tenon joints may be arranged for close fit relationship and such caulking or sealing compound as may be desired may be applied to the interior and/or exterior surface of the log walls at the junctures between adjacent logs after the building walls have been assembled.

In the illustrated construction, each mortise log has an extending end portion, that is an end portion which extends beyond the log courses immediately above and below it, which courses are formed by tenon logs. If desired, log end pieces may be provided to fill the spaces between the extending end portions of the mortise logs thereby creating the appearance that the walls are formed by logs which may be of substantially equal length interfitted in crossing relation at the corners. Such a log end piece is shown in FIGS. 1–3 and indicated generally by the reference numeral 50*b*. The illustrated log end piece 50*b* is made from a log cant and has upper and lower surfaces respectively indicated at 20*b* and 26*b*. A tongue 24*b* projects above the upper surface and a corresponding groove 26*b* is formed which opens through the lower surface. An end portion of the log end 50*b* is received within and generally complements an associated portion of the notch 38*a*. The log end 50*b* is laid horizontally in tongue and groove relation upon the extending end portion of the log 16*b* and extends outwardly in normal relation to the log 16*a* in general longitudinal alignment with the log 18*b*. Thus, the log end piece 50*b* comprises a false log end which appears to be an extension or continuation of the log 18*b*. In like manner, another log end piece 50*a* is provided which appears to comprise an extending end portion of the log 18*a*, as shown in FIGS. 1 and 2, however, this log end piece is omitted from FIG. 3 for clarity of illustration.

Figure 6:
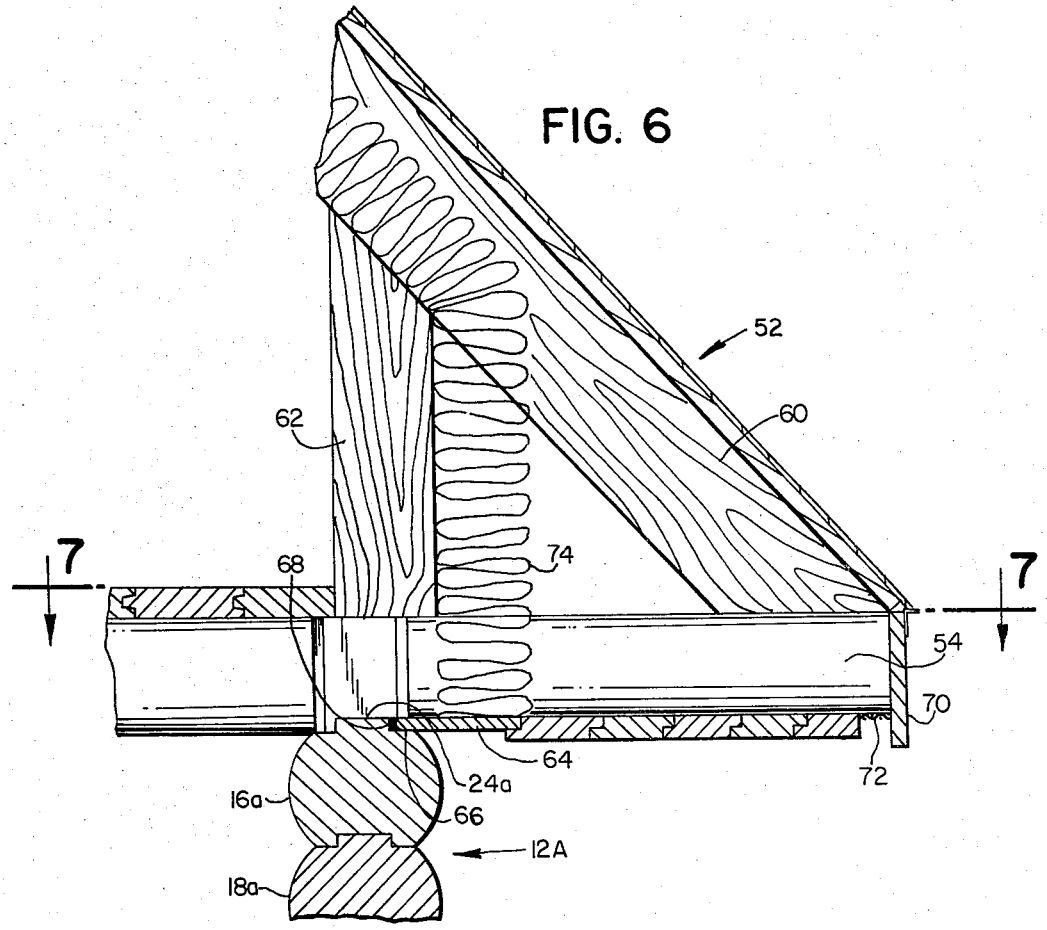
FIG. 6 is a fragmentary vertical sectional view through a portion of a building and shows an overhanging portion of the roof structure.
Figure 7:
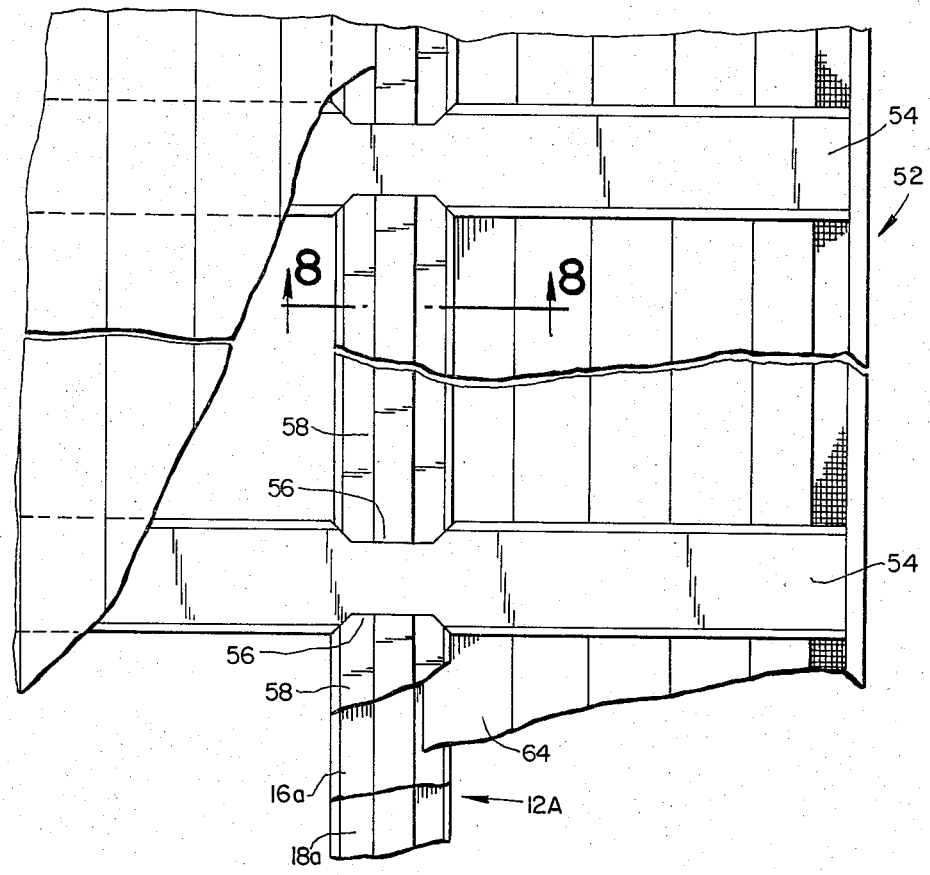
FIG. 7 is a fragmentary sectional view taken generally along the line 7—7 of FIG. 6.

Referring now to FIGS. 6 and 7, the eave portion of a typical roof structure embodying the invention is indicated generally by the reference numeral 52. The illustrated eave structure 52 facilitates provision of improved weathertight joints and the improved application of insulating material in this critical portion of the building where high heat loss may be anticipated. Referring particularly to FIG. 6, the building has a wall 12A which includes log courses 16*a* and 18*a*. Parallel joists 54, 54 supported on the upper log course 16*a* extend between the wall 12*a* and an opposite wall of the building (not shown) and may support conventional flooring material, as shown in FIG. 7. The outer end portion of each joist 54 extends outward in cantilever position beyond the wall 12A and has its lower surface rabbeted to a depth substantially equal to the vertical dimension of the tongue 24*a* on the log 16*a* to engage the tongue, substantially as shown. Each joist 54 has shallow vertically disposed notches 56, 56 which open laterally through its opposite sides in vertical alignment with the wall 12A. The configuration of each notch 56 is generally similar to the configuration of the notch 38*a*, previously described.

Figure 8:
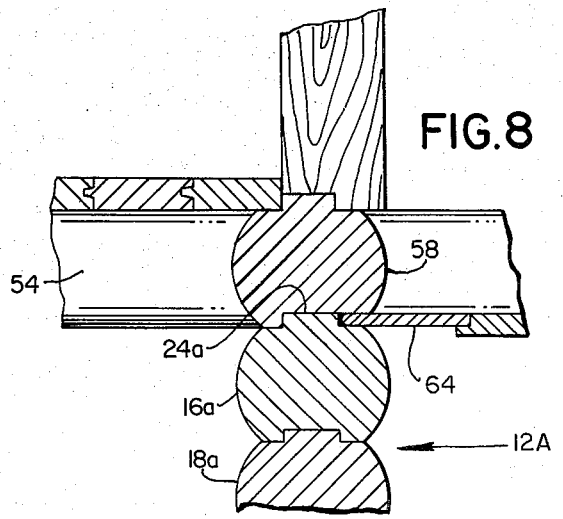
FIG. 8 is a fragmentary sectional view taken along the line 8—8 of FIG. 7.

Filler logs 58, 58 laid horizontally upon the log course 16*a* extend between adjacent joists 54, 54 and have end portions which are received within and generally complement notches 56, 56, as best shown in FIG. 7. The lower surface of each filler log 58 is rabbeted as best shown in FIG. 8 to rest on the tongue 24*a* of the upper log course 16*a*. Rafters 60 secured to the outer end portions of the joists 54, 54 are supported, in part, by rafter braces 62, 62 which extend up from the joists 54, 54, as shown in FIG. 6. The rafters support a conventional sloped roof structure.

A soffit 64 which has a thickness substantially equal to the vertical dimension of the tongue 24*a* is fastened to the underside of the outwardly extending joists 54, 54, as best shown in FIG. 6. The soffit 64 has an inner marginal edge portion 66 disposed between the joists 54, 54 and the upper surface 20*a* of the log course 16*a* and rests upon the latter upper surface. The soffit further includes a vertically disposed inwardly facing inner edge 68 in substantial engagement with an associated outwardly facing side surface of the tongue 24*a*. If desired, suitable sealing or caulking material may be provided between the inner edge of the soffit and the associated side edge of the tongue 24*a*.

The eave structure 52, is finished by a facia board 70 fastened to the outer ends of the joists 54, 54. A vent screen, such as indicated at 72, associated with the soffit may be provided, if desired. Insulating material 74 is preferably applied, substantially as shown in FIG. 6, to minimize heat loss in this critical region of the building.

Figure 9:
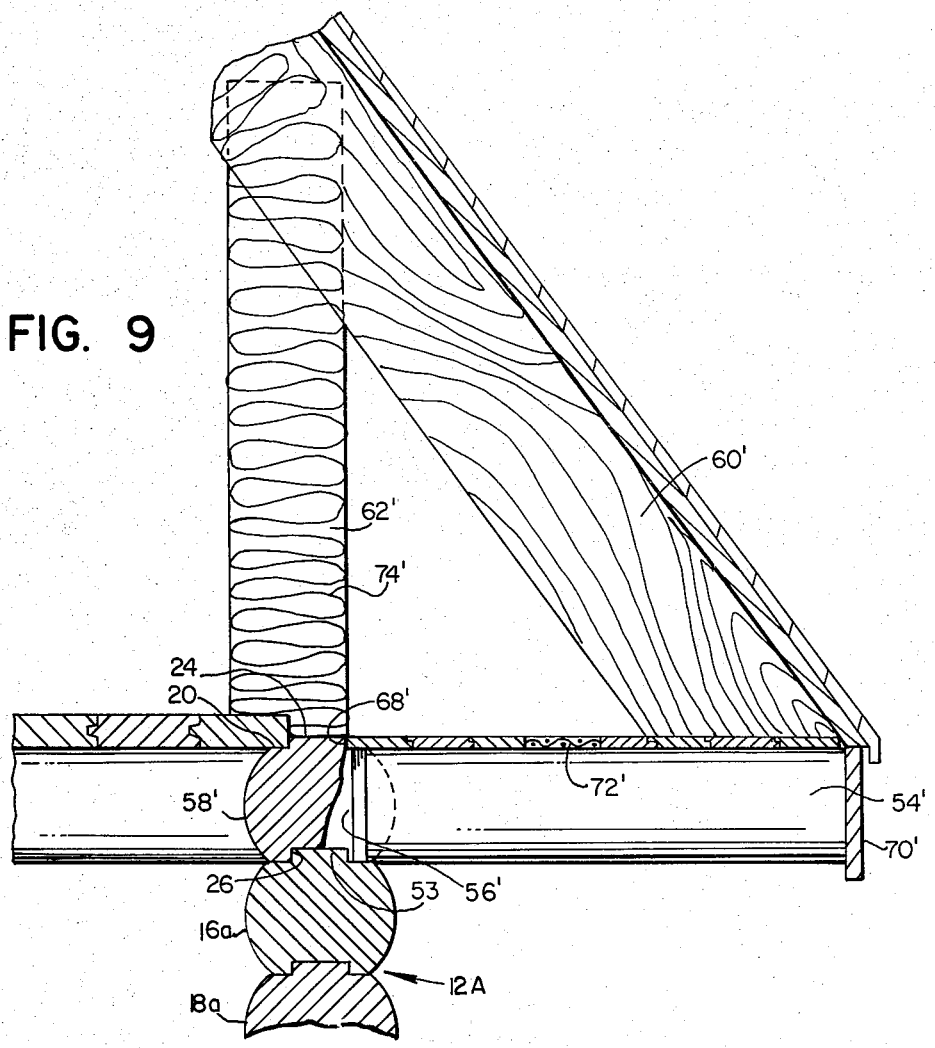
FIG. 9 is similar to FIG. 6, but shows another embodiment of the invention.

Another roof construction which provides substantial eave overhang is shown in FIG. 9. The illustrated structure includes a log wall 12A which has an upper log course 16*a*. A plurality of joists 54′ supported on the wall 12A and an opposite wall of the building (not shown) have overhanging or cantilevered portions which extend out beyond the wall 12A. Each joist 54′ has a saddle notch 53 in its lower surface to receive the tongue 24*a* on the log 16*a*. Each joist 54′ has vertically disposed notches 56′, 56′ in its opposite sides substantially identical to the notches 56, 56, previously described, for receiving the associated end portions of filler logs 58′, 58′ which are laid horizontally upon the log 16*a* and extending between adjacent joists 54′, 54′, substantially as shown in FIG. 9. Each filler log 58′ has a tongue 24 which projects above its upper surface and a groove 26 in its lower surface for receiving the tongue 24*a* on the log course 16*a* therebelow. The joists and the filler logs are dimensioned so that the upper surfaces of the filler logs, designated 20, are substantially aligned with the upper surfaces of the joists and the tongues 24, 24 on the filler logs extend above the upper surfaces of the joists 54′, 54′, as best shown in FIG. 9. A soffit 64′ is supported on the upper surfaces of the cantilevered portions of the joists 54′, 54′. The soffit has an inner marginal edge portion which rests on the upper surfaces 20 of the filler logs and an inwardly facing inner edge 68′ which engages an associated side edge of the tongues 24, 24. Rafters 60′, 60′ (one shown) rest on the outer end portion of the soffit and are supported, in part, by rafter braces 62′, 62′ which project from the rafters, substantially as shown. The rafters support a conventional roof structure which terminates near a facia board 70′ secured to the outwardly extending ends of the joists 54′, 54′. Flooring material may be laid on the joists inwardly of the walls, substantially as shown. Insulating material 74′ is preferably applied, as shown, to minimize heat loss. A vent 72′ may also be provided.

We claim:

1. In a log building, a pair of walls intersecting in angular relation at a corner and comprising horizontally extending logs, each log having horizontally disposed upper and lower surfaces, a tongue projecting above said upper surface and extending longitudinally of said log, and a groove opposite said tongue and opening through said lower surface, said groove extending longitudinally of said log in parallel relation to said tongue, one of said logs having a vertically disposed mortise extending through said log and spaced from an end thereof, said mortise opening laterally outwardly through one side of said one log and having a generally V-shaped outwardly diverging outer end portion defined by a pair of vertically disposed wall surfaces and a generally rectangular inner end portion opening into said outer end portion and partially defined by a pair of vertically disposed opposing side walls, each of said side walls intersecting an associated one of said wall surfaces, another of said logs having a tenon formed on an end thereof and received within said mortise at said corner, said tenon having a rectangular outer end part received within and substantially complementing said inner end portion and an inner end part received within and substantially complementing an associated part of said outer end portion.

2. The combination as set forth in claim 1 wherein said outer end part of said other log is partially defined by said tongue of said other log.

3. The combination as set forth in claim 1 wherein said tongue has a generally rectangular vertical cross section and the lateral width of said outer end part is substantially equal to the lateral width of said tongue.

4. The combination as set forth in any one of claims 1–3 wherein said inner end portion is partially defined by said tongue on said one log.

5. The combination as set forth in claim 3 wherein said inner end portion has a longitudinal width substantially equal to the width of said tongue and a lateral depth substantially less than the width of said tongue.

6. The combination as set forth in claim 1 wherein said one log has a saddle notch opening through said lower surface and extending laterally therethrough in lateral alignment with said inner end portion, said saddle notch having a vertical cross section substantially complementing the vertical cross section of said tongue.

7. The combination as set forth in claim 1 wherein said one log has a vertically disposed notch therein laterally aligned with said mortise and opening laterally outwardly through the side thereof opposite said one side and defined by a vertically disposed inner end wall generally parallel to the longitudinal axis of said one log and laterally spaced therefrom and a pair of vertically disposed side walls inclined inwardly toward said inner end wall and toward each other and said logs include a log end piece having an end portion received within and generally complementing said notch and said log end piece extends outward from said one log in general longitudinal alignment with said other log.

8. The combination as set forth in claim 4 wherein the longitudinal center line of said tongue on each of said logs is disposed within a vertical reference plane containing the longitudinal center line of the log and each of said vertically disposed wall surfaces is disposed at a 45 degree angle relative to a vertical reference plane containing the longitudinal center line of said one log.

9. A log building having walls including logs laid horizontally upon each other and joined together in tongue and groove relation, said walls intersecting in angular relation at corners and joined at said corners by mortise and tenon joints defined by pairs of associated logs, each of said walls including an upper log course having a horizontally disposed upper surface and a tongue projecting above said upper surface and extending longitudinally of said log course, a plurality of horizontally spaced joists supported on the upper log course of one of said walls and extending in cantilever position beyond said one wall, a plurality of filler logs, each of said filler logs laid horizontally upon said upper log course and extending between a pair of adjacent joists, and a soffit secured to outwardly extending portions of said joists and having an inner marginal edge portion resting on an associated portion of the upper surface of one of said logs and a vertically disposed inwardly facing inner edge engaging an associated side surface of a tongue on said one log.

10. A log building having a wall including a plurality of logs laid horizontally upon each other, each of said logs having upper and lower surfaces, a tongue projecting above said upper surface and extending longitudinally of the log, and a groove opening through said lower surface and extending longitudinally of said log in parallel relation to said tongue, said groove in each of said logs receiving therein said tongue of an adjacent log immediately therebelow, a plurality of horizontally spaced joists supported on the upper log course of said wall and extending therebeyond in cantilever position, said logs including a plurality of filler logs, each of said filler logs extending between a pair of adjacent joists, and a soffit secured to outwardly extending portions of said joists and having an inner marginal edge portion resting on an associated portion of the upper surface of one of said logs and a vertically disposed inwardly facing inner edge engaging an associated side surface of a tongue on said one log.

11. The combination as set forth in claim 10 wherein each of said joists has at least one notch formed in a side thereof and receiving an associated end portion of a filler log therein.

12. The combination as set forth in claim 10 wherein each of said joists has a saddle notch opening through its lower surface and extending laterally therethrough and receiving said tongue on said upper log course therein.

13. The combination as set forth in claim 10 wherein said one log comprises said upper log course.

14. The combination as set forth in claim 10 wherein each of said filler logs has a horizontally disposed upper surface and a tongue projecting above said upper surface and said one log comprises a filler log.

* * * * *